US005167102A

United States Patent [19]

Nakatsubo et al.

[11] Patent Number: 5,167,102

[45] Date of Patent: Dec. 1, 1992

[54] REVERSIBLE FOOTBOARD FOR STAIRCASE

[75] Inventors: Masafumi Nakatsubo; Takashi Kobayashi, both of Tokyo, Japan

[73] Assignee: Tsuda Corporation, Osaka, Japan

[21] Appl. No.: 795,947

[22] Filed: Nov. 18, 1991

[30] Foreign Application Priority Data

Jul. 8, 1991 [JP] Japan ..... 3-192720

[51] Int. Cl.[5] ..... E04F 11/00

[52] U.S. Cl. ..... 52/188; 52/183; 52/189; 52/191

[58] Field of Search ..... 52/189, 191, 188, 183, 52/182, 184, 187, 179

[56] References Cited

U.S. PATENT DOCUMENTS 1,716,224 6/1929 Friderichsen ..... 52/189
1,731,300 10/1929 Ehlers ..... 52/660
3,311,996 4/1967 Bergener ..... 52/182
3,981,112 9/1976 Dake ..... 52/189 X
4,355,700 10/1982 Matthews et al. ..... 52/187 X

FOREIGN PATENT DOCUMENTS 2704397 8/1978 Fed. Rep. of Germany ..... 52/189
0832919 4/1960 United Kingdom ..... 52/189

*Primary Examiner*—Richard E. Chilcot, Jr.
*Assistant Examiner*—Robert J. Canfield
*Attorney, Agent, or Firm*—Flynn, Thiel, Boutell & Tanis

[57] ABSTRACT

A reversible footboard for staircase is capable of changing the pattern on the same footboard by decorating the obverse and reverse surfaces thereof with different patterns. The reversible footboard for staircase to be fixed to notchboards for forming a staircase comprises a flat portion decorated with different patterns on obverse and reverse surfaces thereof either of which serves as a footstep portion, an upward projecting portion provided on one end of the flat portion for serving as a riser and a downward projecting portion provided on the other end of the flat portion.

6 Claims, 2 Drawing Sheets

REVERSIBLE FOOTBOARD FOR STAIRCASE

BACKGROUND OF THE INVENTION

1. Field of the Invention

The present invention relates to a reversible concrete footboard to be fixed to notchboards for forming a staircase.

2. Description of the Related Art

A conventional concrete footboard to be fixed to notchboards for forming a staircase comprises a flat footstep portion which is decorated with a pattern on the surface thereof and a riser which projects upward at the tip end thereof.

However, inasmuch as the footstep portion and the riser are determined in manufacturing the concrete footboard, the pattern on the footstep portion cannot be changed without replacing the footboard with another.

SUMMARY OF THE INVENTION

The present invention has been made in view of the drawbacks of the conventional footboard set forth above, and is to provide a reversible footboard for staircase which is capable of changing the pattern on the same footboard by decorating the obverse and reverse surfaces thereof with different patterns.

In order to achieve the object set forth above, the reversible footboard for staircase according to the present invention comprises a substantially flat portion which is decorated with different patterns on the obverse and reverse surfaces thereof and serves for a footstep portion on either surface thereof, an upward projecting portion at one end of the flat portion for serving as a riser and a downward projecting portion at the other end of the flat portion.

When the surface of the flat portion decorated with the desired pattern may be directed upward to form the footstep portion, the upward projecting portion at one end of the flat portion serves as a riser, which can be connected to the notchboards to form the staircase. Accordingly, the footboard serves for two kinds of staircases having different patterns matching the environment.

DESCRIPTION OF THE PREFERRED EMBODIMENT

A reversible footboard for staircase according to a first embodiment of the present invention will be described with reference to FIG. 1 to FIG. 3.

Figure 1:
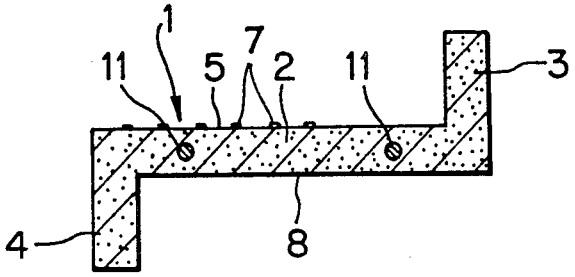
FIG. 1 is a cross-sectional view of a reversible footboard for staircase according to a first embodiment of the present invention.

A concrete footboard 1 as illustrated in FIG. 1 has a basic cross sectional form of the present invention. That is, a flat portion 2 which is substantially formed flat and has projecting portions which are projected in the opposite directions at both ends thereof. The upward projecting portion serves as a riser 3, while the downward projecting portion 4 serves as the riser when the footboard 1 is used upside down.

Figure 2:
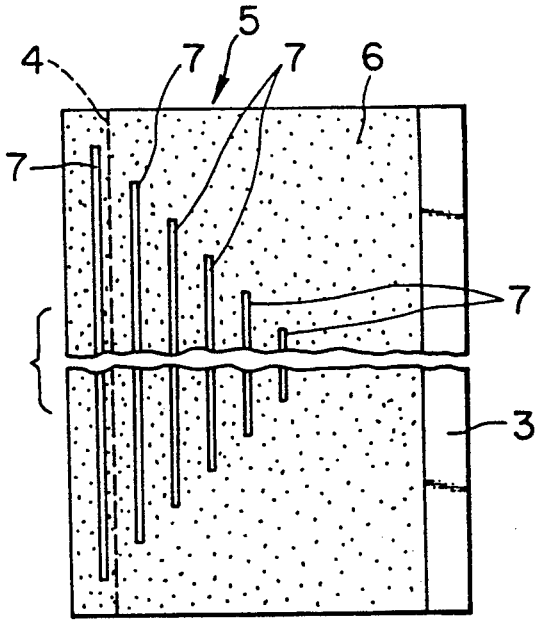
FIG. 2 is a plan view of the reversible footboard according to the first embodiment of the present invention.

The footboard 1 is composed of super-reinforced concrete and has the flat portion 2 which is decorated, for example, with a protruding pattern 7 on one surface 5 thereof so as to form a nonskid footstep which is a rough surface 6 having a plurality of protruding lines thereon as illustrated in FIG. 2. The flat portion 2 is also decorated with a pattern composed of a very rough portion 9 and a flat portion 10 on the other surface 8 thereof as illustrated in FIG. 3. Buried in the portions near the both ends of the flat portion 2 are reinforcing materials such as iron bars 11 for fixedly mounting the footboard 1 on notchboards, not shown.

Figure 3:
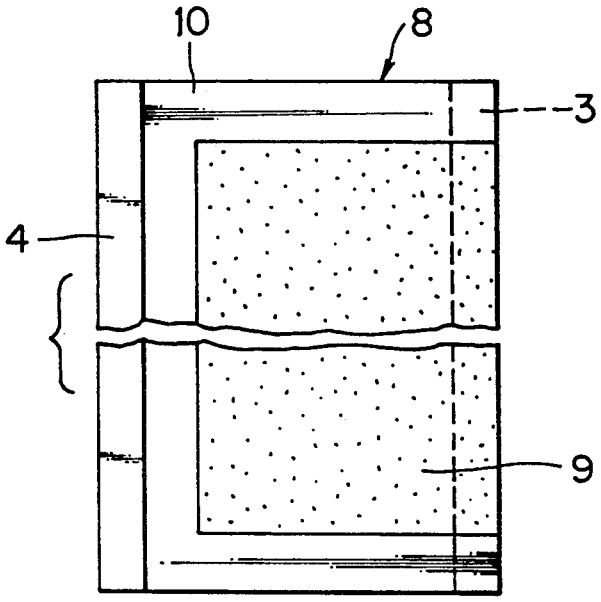
FIG. 3 is a bottom view of the reversible footboard according to the first embodiment of the present invention.

Accordingly, the footboard arranged in a position where the projecting portion 3 serves as the riser may be fixedly mounted on the notchboards when the surface 5 having the nonskid protruding pattern 7, which is composed of a plurality of protruding lines on the rough surface 6, is used for a footstep surface as illustrated in FIG. 1, while the footboard arranged in a position where the projecting portion 4 serves as a riser may be fixedly mounted on the notchboards when the surface 8 having the nonskid protruding pattern, which is composed of the very rough portion 9 and the flat portion 10 is used for the footstep portion as illustrated in FIG. 3.

Figure 4:
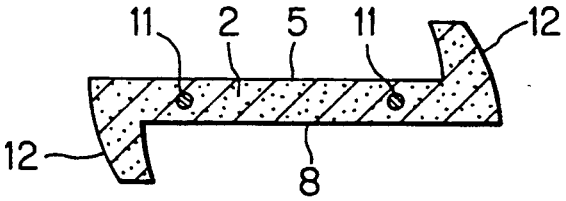
FIG. 4 is a cross-sectional view of the reversible footboard according to a second embodiment of the present invention.
Figure 5:
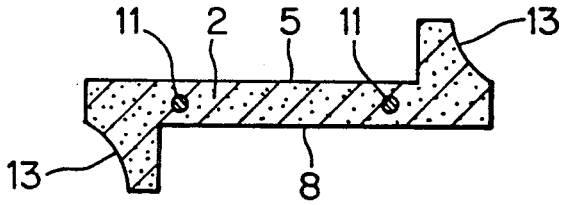
FIG. 5 is a cross-sectional view of the reversible footboard according to a third embodiment of the present invention.
Figure 6:
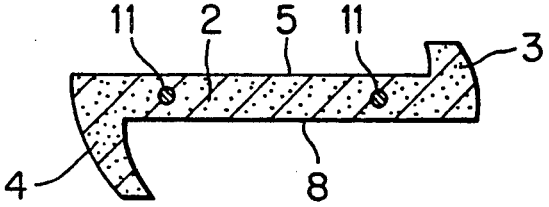
FIG. 6 is a cross-sectional view of the reversible footboard according to a fourth embodiment of the present invention.

The reversible footboard for staircase is varied which is illustrated in FIGS. 4 to 6.

The same components described in the first embodiment are denoted at the same numerals in the second to the fourth embodiment and the explanations thereof are omitted.

FIG. 4 shows a reversible footboard for staircase according to a second embodiment of the present invention wherein the projecting portions have convex curved surfaces 12, 12 so that the staircase is used more safe and decorative.

FIG. 5 shows a reversible footboard according to a third embodiment of the present invention wherein the projecting portions have concave curved surfaces 13, 13 which form risers.

FIG. 6 shows a reversible footboard for staircase according to a fourth embodiment of the present invention wherein the projecting portions 3, 4 are not equal in length.

Various kinds of patterns can decorate both the surfaces of the flat portion so long as the pattern on the obverse surface is different from that on the reverse surface and they are intended to be of practical use and ornament. Furthermore, the projecting portions formed on both side of the flat portion can have various shapes for the purpose of practical use and ornament.

What is claimed is:

1. A reversible tread for a staircase adapted to be fixed to notchboards for forming a linear staircase, comprising:

a generally planar, horizontal, tread portion having substantially flat, substantially parallel, obverse and reverse surfaces, each of said surfaces being provided with a differently shaped, unsmooth, surface contour, either of which surfaces is capable of serving as a footstep portion;

an upwardly projecting portion provided on one end of the tread portion for serving as a riser; and a downwardly projecting portion provided on the other end of the tread portion.

2. A reversible tread for a staircase according to claim 1, wherein the tread is formed of concrete.

3. A reversible tread for a staircase according to claim 1, wherein the upwardly and downwardly projecting portions have convex curved surfaces.

4. A reversible tread for staircase according to claim 1, wherein the upwardly and downwardly projecting portions have concave curved surfaces.

5. A reversible tread for a staircase according to claim 1, wherein the height of the upwardly projecting portion is equal to that of the downwardly projecting portion.

6. A reversible tread for a staircase according to claim 1, wherein the height of the upwardly projecting portion is not equal to that of the downwardly projecting portion.

* * * * *